US010680394B2

(12) United States Patent
Zhao et al.

(10) Patent No.: US 10,680,394 B2
(45) Date of Patent: Jun. 9, 2020

(54) ELECTRICAL CONNECTOR HAVING A CONTACT WITH UPPER AND LOWER CONTACTING PORTIONS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/374,741

(22) Filed: Apr. 3, 2019

(65) Prior Publication Data

US 2019/0312393 A1 Oct. 10, 2019

(30) Foreign Application Priority Data

Apr. 4, 2018 (CN) ..... 2018 1 0298718

(51) Int. Cl.
*H01R 24/60* (2011.01)
*H01R 43/00* (2006.01)

(52) U.S. Cl.
CPC ..... *H01R 24/60* (2013.01); *H01R 43/00* (2013.01)

(58) Field of Classification Search
CPC ..... H01R 24/60; H01R 43/00; H01R 2107/00
See application file for complete search history.

(56) References Cited

U.S. PATENT DOCUMENTS

| | | | | |
|---|---|---|---|---|
| 9,450,354 | B2 * | 9/2016 | Little | H01R 24/60 |
| 2014/0206209 | A1 | 7/2014 | Kamei et al. | |
| 2014/0235095 | A1 | 8/2014 | Jones et al. | |
| 2016/0093994 | A1 | 3/2016 | Chen et al. | |
| 2016/0352051 | A1 * | 12/2016 | Tsai | H01R 13/405 |
| 2017/0117673 | A1 * | 4/2017 | Zhang | H01R 24/60 |

(Continued)

FOREIGN PATENT DOCUMENTS

| | | |
|---|---|---|
| CN | 205122849 | 3/2016 |
| CN | 105655763 | 6/2016 |
| TW | M540410 | 4/2017 |

*Primary Examiner* — Oscar C Jimenez
(74) *Attorney, Agent, or Firm* — Wei Te Chung; Ming Chieh Chang

(57) ABSTRACT

An electrical connector includes: an insulative housing having a front tongue with two opposite surfaces; and plural contacts with contacting portions exposed to the two opposite surfaces of the tongue; wherein the plural contacts are formed from a single contact carrier with each contact having a first contacting portion; and at least one of the plural contacts has a second contacting portion oriented symmetrically with respect to the first contacting portion thereof. A method of making a contact module of the electrical connector is characterized by the steps of: forming the plural contacts from a single contact carrier with each contact having a first contacting portion; and bending at least one of the plural contacts to form a second contacting portion oriented symmetrically with respect to the first contacting portion thereof.

15 Claims, 11 Drawing Sheets

(56) References Cited

U.S. PATENT DOCUMENTS

| | | | | |
|---|---|---|---|---|
| 2017/0133797 | A1* | 5/2017 | Guo | H01R 13/405 |
| 2017/0288326 | A1* | 10/2017 | Wang | H01R 12/775 |
| 2017/0324188 | A1* | 11/2017 | Guo | H01R 13/405 |
| 2017/0373439 | A1* | 12/2017 | Wen | H01R 13/04 |
| 2018/0006408 | A1 | 1/2018 | Wen et al. | |
| 2018/0062324 | A1* | 3/2018 | Wu | H01R 13/6616 |
| 2018/0175555 | A1* | 6/2018 | Zhao | H01R 13/6471 |
| 2018/0337486 | A1* | 11/2018 | Zhao | H01R 12/724 |
| 2019/0115678 | A1* | 4/2019 | Zhao | H01R 13/03 |
| 2019/0229459 | A1* | 7/2019 | Zhou | H01R 12/7023 |

* cited by examiner

| A1 | A2 | A3 | A4 | A5 | A6 | A7 | A8 | A9 | A10 | A11 | A12 |
|---|---|---|---|---|---|---|---|---|---|---|---|
| | | | | | D− | D+ | | | | | |
| VGND | | | Vcc | Vb | D+ | D− | | | | | VGND |
| B12 | B11 | B10 | B9 | B8 | B7 | B6 | B5 | B4 | B3 | B2 | B1 |

FIG. 11

ELECTRICAL CONNECTOR HAVING A CONTACT WITH UPPER AND LOWER CONTACTING PORTIONS

BACKGROUND OF THE INVENTION

1. Field of the Invention

The present invention relates to an electrical connector including an insulative housing having a front tongue with two opposite surfaces and a plurality of contacts with contacting portions exposed to the two opposite surfaces of the tongue, wherein the plurality of contacts are formed from a single contact carrier with each contact having a first contacting portion and with at least one contact having a second contacting portion oriented symmetrically with respect to the first contacting portion thereof. The present invention also relates to a method of making such electrical connector to obtain a plurality of contacts thereof from a single contact carrier, where at least one of the plurality of contacts has both first and second contacting portions oriented centrally-symmetrically.

2. Description of Related Arts

China Patent No. 205122849 discloses an electrical connector, including: an insulative housing having a front tongue with an upper and a lower surfaces, a lower row of contacts with first contacting portions exposed to the lower surface of the tongue, and an upper row of contacts with second contacting portions exposed to the upper surface of the tongue. Specifically, at least one contact of the lower row of contacts further has a second contacting portion bent to expose to the upper surface of the tongue. The first contacting portions in the lower row are oriented symmetrically with respect to the second contacting portions in the upper row and the second contacting portion bent from the at least one contact of the lower row. The contact having both first and second contacting portions, i.e., a second contacting portion bent from the other row, is formed separately, not from a same contact carrier where it comes from, which proves difficult to make.

SUMMARY OF THE INVENTION

An electrical connector comprises: an insulative housing having a front tongue with two opposite surfaces; and a plurality of contacts with contacting portions exposed to the two opposite surfaces of the tongue; wherein the plurality of contacts are formed from a single contact carrier with each contact having a first contacting portion; and at least one of the plurality of contacts has a second contacting portion oriented symmetrically with respect to the first contacting portion thereof. A method of making a contact module of the electrical connector is characterized by the steps of: forming the plurality of contacts from a single contact carrier with each contact having a first contacting portion; and bending at least one of the plurality of contacts to form a second contacting portion oriented symmetrically with respect to the first contacting portion thereof.

BRIEF DESCRIPTION OF THE DRAWING

FIG. 11 is a schematic table showing contact arrangement of the electrical connector.

DETAILED DESCRIPTION OF THE PREFERRED EMBODIMENT

Figure 1:
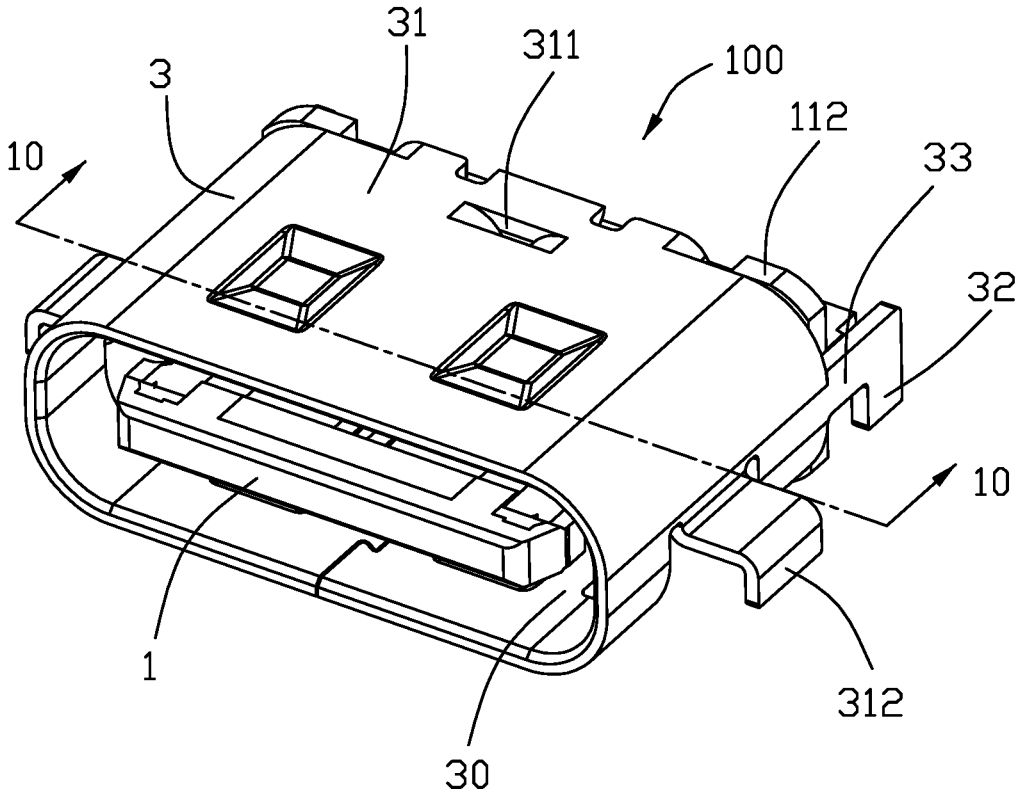
FIG. 1 is a perspective view of an electrical connector in accordance with the present invention.
Figure 2:
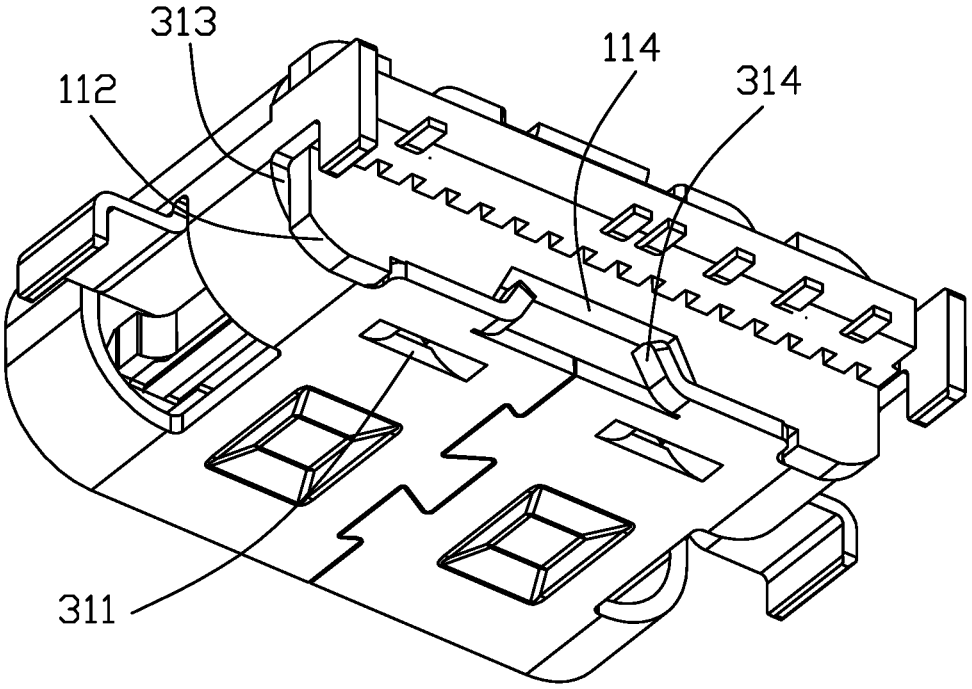
FIG. 2 is a view similar to FIG. 1 but from another perspective.
Figure 3:
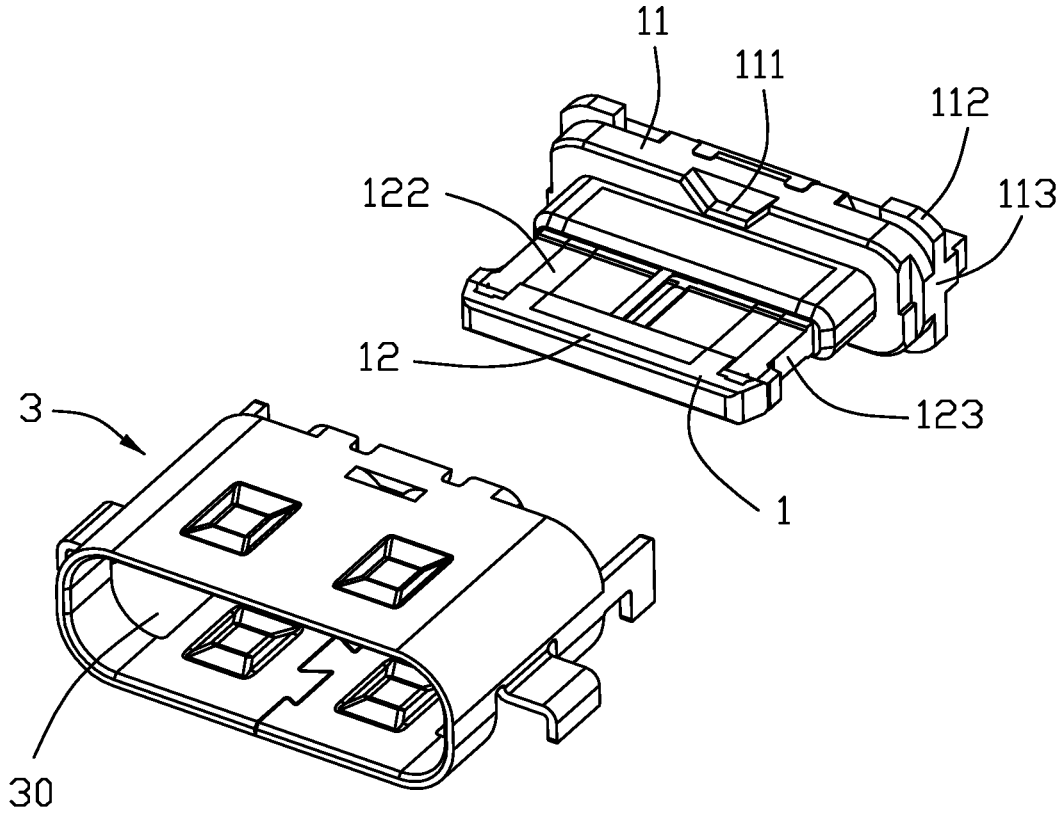
FIG. 3 is an exploded view of the electrical connector in FIG. 1.

Referring to FIGS. 1-11, an electrical connector 100 in accordance with the present invention supports mating in two orientations. The electrical connector 100 comprises an insulative housing 1 and a plurality of contacts 2. The electrical connector 100 may further comprise a shielding shell 3 enclosing the insulative housing 1 to form a mating space 30.

Figure 4:
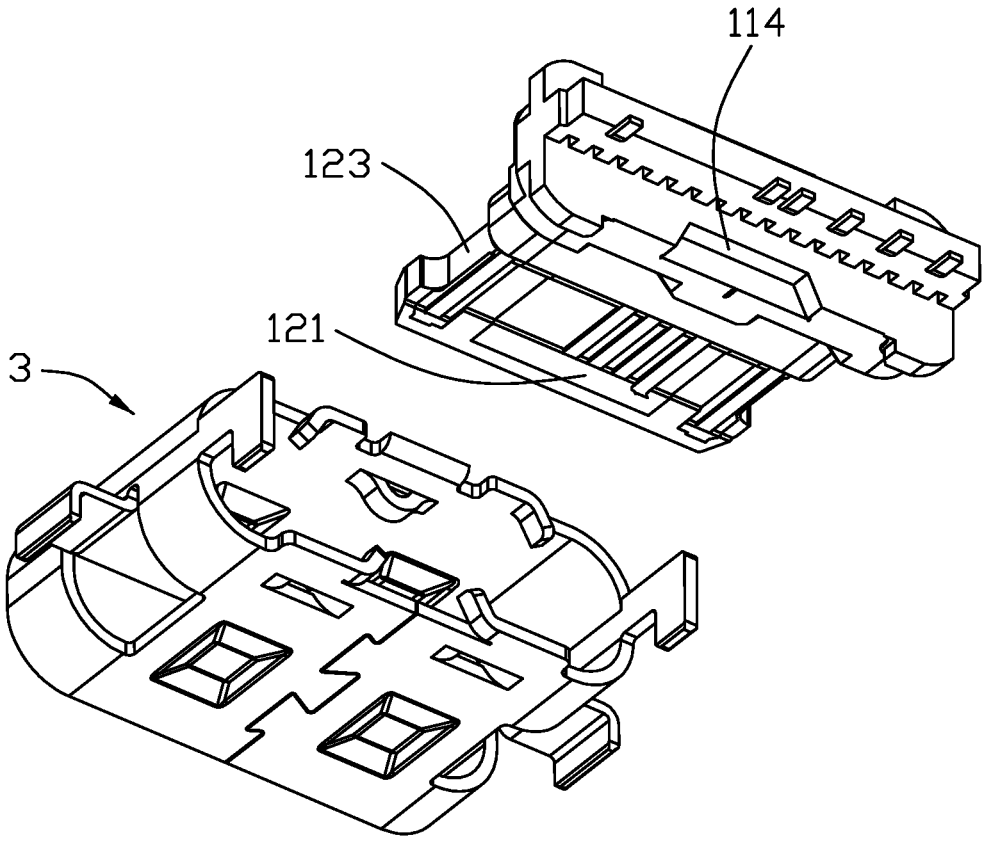
FIG. 4 is an exploded view of the electrical connector in FIG. 2.
Figure 5:
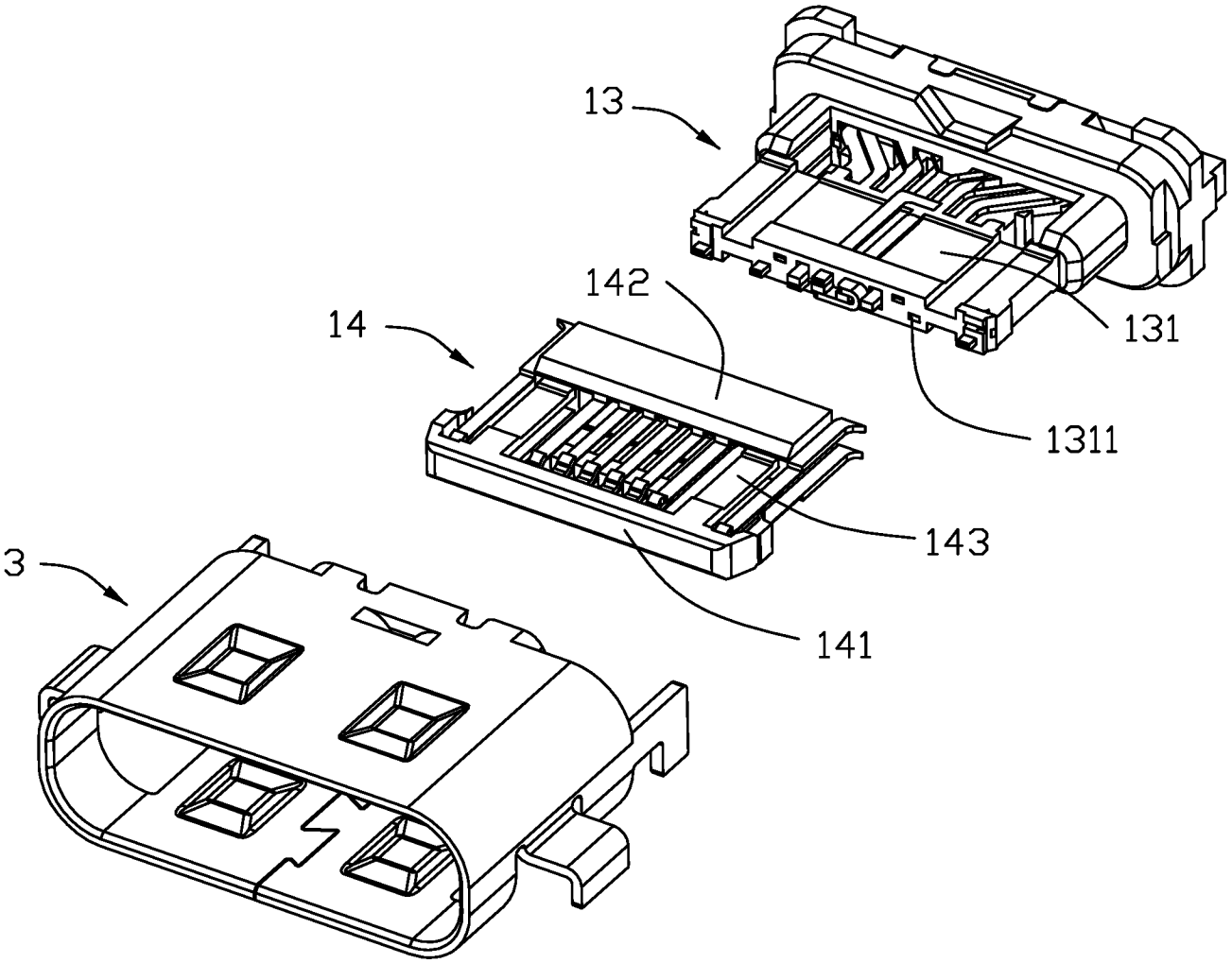
FIG. 5 is a further exploded view of the electrical connector in FIG. 3.
Figure 6:
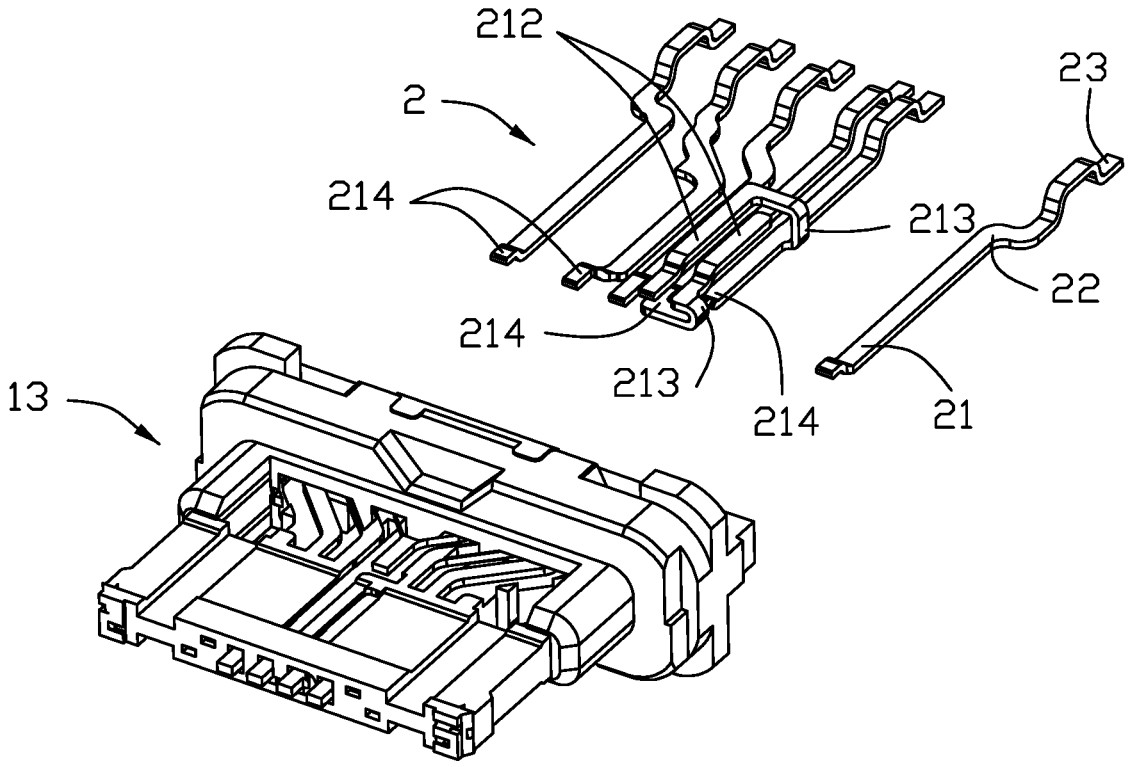
FIG. 6 is a further exploded view of a contact module of the electrical connector in FIG. 5.
Figure 7:
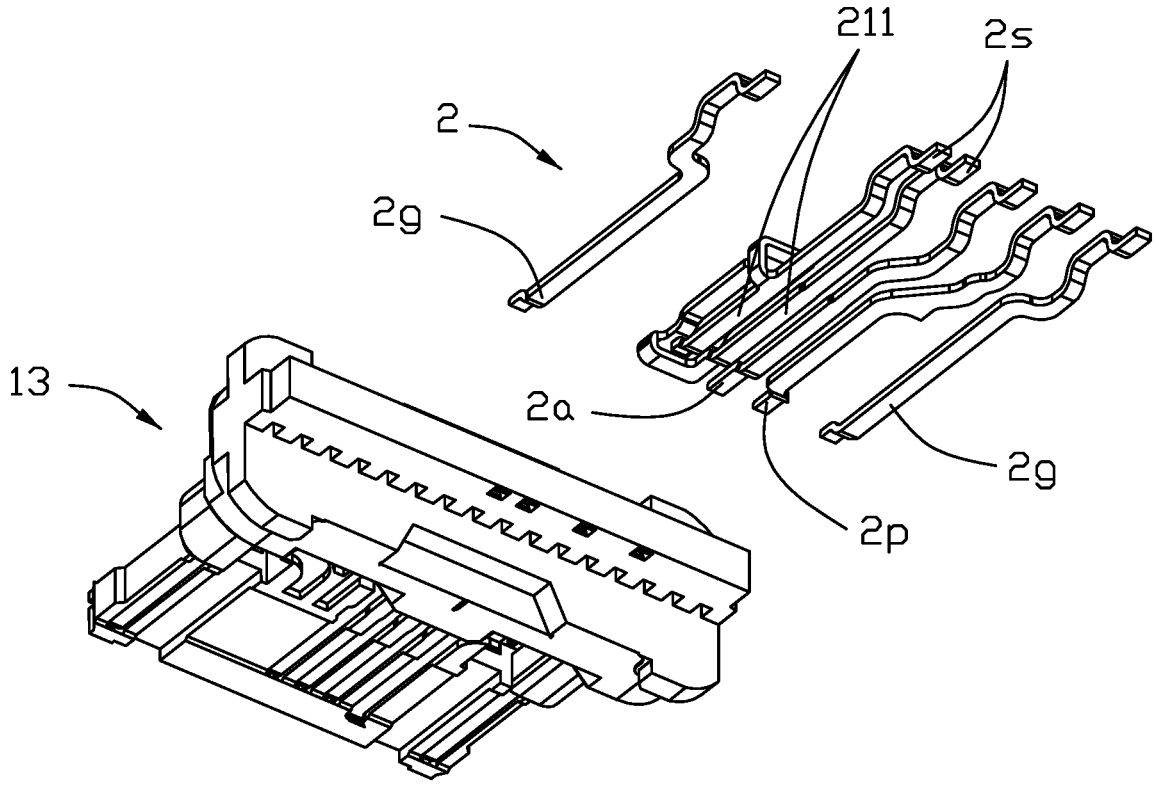
FIG. 7 is a view similar to FIG. 6 but from another perspective.
Figure 8:
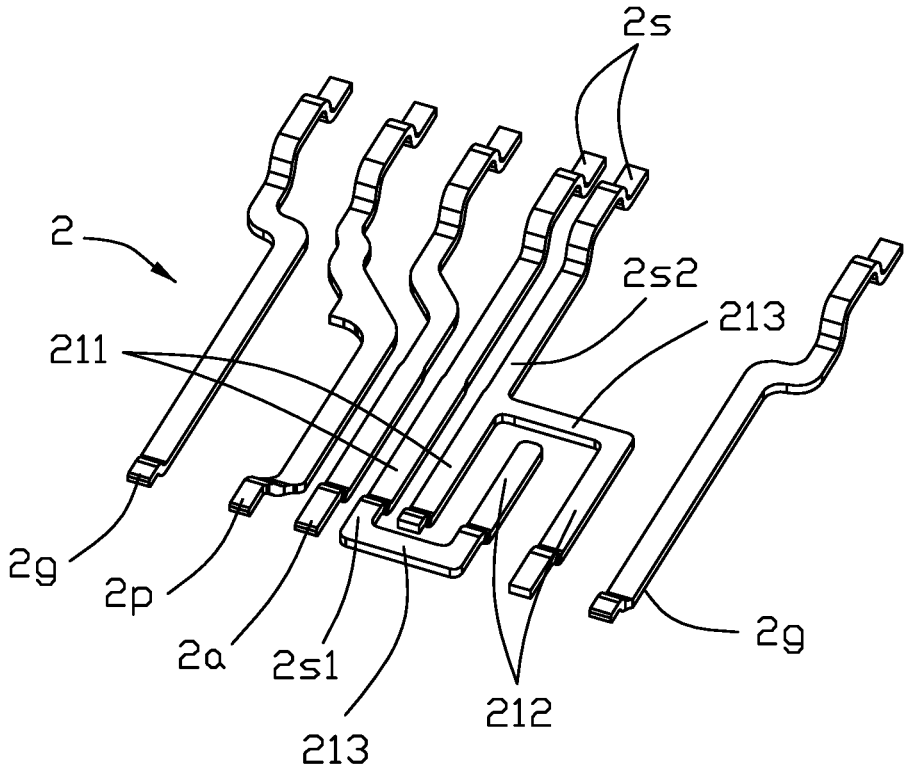
FIG. 8 shows a plurality of contacts of the electrical connector prior to a bending operation.

Referring specifically to FIGS. 1-5, the insulative housing 1 has a base 11 and a frontal tongue 12 for exposing contacting portions of the contacts 2 in a well-known manner. The base 11 has features 111, 112, 113, and 114 for cooperating with corresponding features provided on the shell 3. The tongue 12 extending forwardly from the base 11 with a stepped structure (not labeled) at the rear joining portion, has a lower surface 121, an opposite upper surface 122, and a pair of side notches 123. As shown in FIGS. 4-5 and 11, the lower surface 121 provides twelve (12) contact positions B1 through B12, and in a centrally-symmetrically manner to support dual-orientation mating as is well known in this art, the upper surface 122 also provides twelve (12) contact positions A1 through A12, though not all positions are occupied. As shown in FIG. 5, the insulative housing 1 is constructed of a first insulator 13 and a second insulator 14. The first insulator 13 has a recess to expose the contacts 2 and grooves 1311 for contacts are also seen. The second insulator 14 is molded over the first insulator 13 and has a front portion 141, a rear thicker portion 142, and a portion 143 therebetween.

Figure 9:
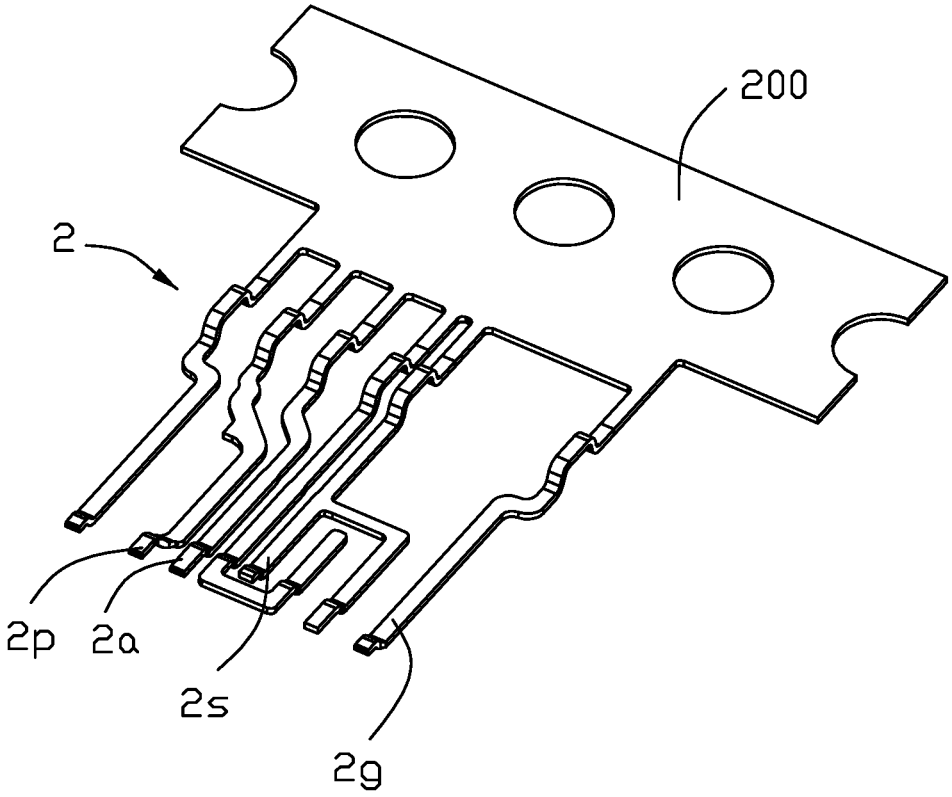
FIG. 9 shows the plurality of contacts connected to a carrier strip.
Figure 10:
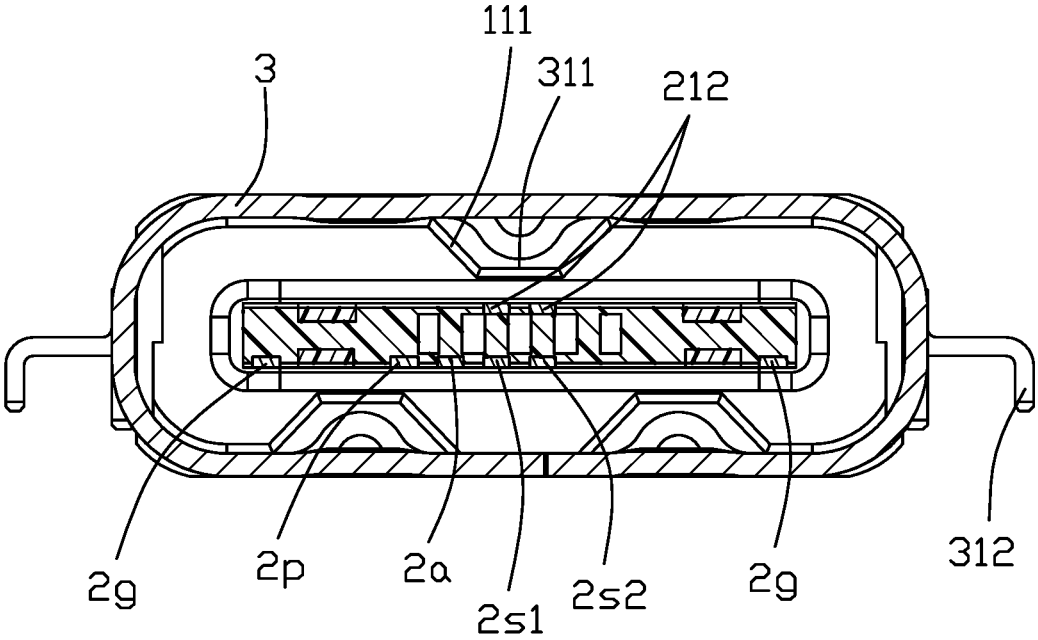
FIG. 10 is a cross-sectional view of the electrical connector taken along line A-A in FIG. 1.

Referring specifically to FIGS. 6-11, the plurality of contacts 2 are generally arranged in a row and exposing to the lower surface 121 of the tongue 12, including two outermost ground contacts 2*g*, one power contact 2*p*, one configuration channel contact 2*a*, and a pair of signal contacts 2*s* for low-speed transmission. Each contact 2 has a rear tail portion (not labeled) and a front contacting portion 21, an embedded portion 214, a securing portion 22, and a soldering portion 23. As shown in FIG. 9, all contacts 2 are formed on and therefore to be severed from a same, single contact carrier, thus simplifying its manufacturing operation. More importantly, at least one of the plurality of contacts 2 has not only a first contacting portion 211 exposing to the lower surface 121 of the tongue 12 but also a second contacting portion 212 exposing to the upper surface 122 of the tongue 12 and oriented symmetrically with respect to this first contacting portion 211, i.e., the first contacting portion and the second contacting portion being respectively located by two sides of a front-to-back extending centerline of the connector in a top view. Preferably, in this embodiment, each of the two signal contacts 2*s*1 and 2*s*2 has both first and second contacting portions 211 and 212. Therefore, one oblique plane (not shown) along the diagonal direction defined by the corresponding first contacting portion 211 and second contacting portion 212 of the signal contacts 2*s*1, and another oblique plane (not shown) defined by those of the signal contact 2*s*2 intersects each other in a front view. Specifically, as seen in FIG. 11, the plurality of contacts 2 include ground contacts 2*g* occupying positions B1 and B12, power contact 2*p* occupying position B9, configuration channel contact 2*a* occupying position B8, and signal contacts 2*s* occupying positions B6 and B7. In this embodiment, all the tail portions of the contacts are located at a same level.

First signal contact 2*s*1 is disposed at position B7 and second signal contact 2*s*2 is disposed at position B6. The second signal contact 2*s*2 is bent at a lateral side distal from the first signal contact 2*s*1 to align the second contacting portion 212 thereof right above the first contacting portion 211 of the first signal contact 2*s*1, i.e., at position A6. Therefore, the second signal contact 2*s*2 has a bend 213 connected at the lateral side of the first contacting portion 211 thereof. Similarly, the first signal contact 2*s*1 is bent at a front end thereof to align the second contacting portion 212 thereof right above the first contacting portion 211 of the second signal contact 2*s*2, i.e., at position A7. Therefore, the first signal contact 2*s*1 has a bend 213 connected at the front end of the first contacting portion 211 thereof. Contact positions A1 through A5 and A8 through A12 are vacant. The bend 213 of the first signal contact 2*s*1 is located in front of the embedded portion 214 of the second signal contact 2*s*2. Contact positions B2 through B5 are also vacant, leaving a space sufficiently large to accommodate the second contacting portions 212 of the two signal contacts 2*s* prior to their bending operation. Therefore, all the contacts 2 may be conveniently produced from a single contact carrier, with the result of the two second contacting portions 212 of the two signal contacts 2*s* being oriented symmetrically with respect to the two first contacting portions 211 thereof for dual-orientation mating purpose.

Referring specifically to FIGS. 1-5 and 10, the shielding shell 3 has a tubular portion 31, a pair of soldering legs 32, and a pair of connecting portions 33. The tubular portion 31 has features 311, 313, and 314, and a pair of positioning legs 312.

By forming the two signal contacts, each having both first and second contacting portions, together with the other contacts, in contrast to forming separately, manufacturing operation of the electrical connector 100 is much simplified.

What is claimed is:

1. An electrical connector comprising: an insulative housing having a front tongue with two opposite surfaces; and a plurality of contacts with contacting portions exposed to the two opposite surfaces of the tongue; wherein the plurality of contacts are formed from a single contact carrier with each contact having a first contacting portion; and at least one of the plurality of contacts has a second contacting portion oriented symmetrically with respect to the first contacting portion thereof; wherein in said at least one of the plurality of contacts, the first contacting portion and the second contacting portion are located at different levels in a vertical direction perpendicular to a horizontal transverse direction along which the contacts are spaced from one another; wherein in said at least one of the plurality of contacts, the first contacting portion and the second contacting portion are reversely symmetrical with each other in a diagonal direction; wherein there are two contacts each having the second contacting portion arranged reversely symmetrical with each other in the diagonal direction, and said two contacts are adjacent to each other in the transverse direction, and the diagonal direction defined by one of said two contacts intersects that defined by the other of said two contacts in a front view.

2. The electrical connector as claimed in claim 1, wherein:

two contacts have second contacting portions, each of the two contacts having a bend connected between the first and second contacting portions thereof; and the bend of one of the two contacts is connected at a lateral side of the first contacting portion thereof.

3. The electrical connector as claimed in claim 1, wherein:

two contacts have second contacting portions, each of the two contacts having a bend connected between the first and second contacting portions thereof; and the bend of one of the two contacts is connected at a front end of the first contacting portion thereof.

4. The electrical connector as claimed in claim 1, wherein the first contacting portions of the plurality of contacts are exposed to one of the two opposite surfaces of the tongue and the second contacting portion of the at least one of the plurality of contacts is exposed to the other of the two opposite surfaces of the tongue.

5. The electrical connector as claimed in claim 1, wherein the one of said two contacts forms a bend connected between the corresponding first contacting portion and second contacting portion thereof and located at a front end of the front tongue, the other of said two contacts forms another bend connected between the corresponding first contacting portion and second contacting portion thereof and located in a rear stepped structure of the front tongue.

6. The electrical connector as claimed in claim 5, wherein before being formed to a corresponding final configuration, the one of said two contacts is arranged in an extended state with the corresponding first contacting portion, second contacting portion and bend commonly forming a rearwardly extending U-shaped structure, while the other of said two contacts is arranged in another extended state with the corresponding first contacting portion, second contacting portion and bend commonly forming another forwardly extending U-shaped structure coupled with said rearwardly extending U-shaped structure in a front-to-back direction perpendicular to both the vertical direction and the transverse direction.

7. The electrical connector as claimed in claim 6, wherein the bend of the one of said two contacts extends in the transverse direction same with that of the other of said two contacts along which the corresponding bend extends.

8. An electrical connector comprising: an insulative housing having a front tongue with two opposite surfaces; and one row of contacts retained in the housing, each of said contacts having a front contacting portion and a rear tail portion; wherein at least one of the plurality of contacts unitarily has a second contacting portion oriented symmetrically with respect to the first contacting portion thereof in a diagonal manner so as to have all the first contacting portions of said contacts commonly located on one of said two opposite surfaces, all the tail portions of said contacts commonly located at a same level in a vertical direction, and the second contacting portion located on the other of said two opposite surfaces; wherein in said at least one of the plurality of contacts, the corresponding first contacting portion and second contacting portion are symmetrically located by two sides of a front-to-back extending centerline of the front tongue in a top view; wherein there are two of said contacts arranged to have the corresponding second contacting portions, an oblique plane along a diagonal direction defined by the corresponding first contacting portion and second contacting portion of one of the two of said contacts, is intersected with another oblique plane along another diagonal direction defined by the corresponding first contacting portion and second contacting portion of the other of said two of the contacts.

9. The electrical connector as claimed in claim 8, wherein in each of said two of the contacts, the second contacting portion is connected with the first contacting portion via a bend extending in a transverse direction perpendicular to the vertical direction, and the second contacting portion of one of said two of the contacts extends forwardly and the second contacting portion of the other of said two of the contacts extends rearwardly.

10. The electrical connector as claimed in claim 9, wherein the bend linked to the rearwardly extending second contacting portion is located at a front end of the front tongue while the bend linked to the forwardly extending second contacting portion is located at a stepped structure formed at a rear end of the front tongue.

11. The electrical connector as claimed in claim 9, wherein both said bends of said two of the contacts extend along the same transverse direction when both said two of the contacts are in an extended state.

12. The electrical connector as claimed in claim 11, wherein in the extended state, the first contacting portion, the second contacting portion and the bend therebetween of the one of said two of the contacts commonly form a U-shaped structure, and those of the other of said two of the contacts form another U-shaped structure oppositely oriented with regard to the U-shaped structure.

13. The electrical connector as claimed in claim 12, wherein in the extended state, said U-shape structure is coupled with said another U-shapes structure with overlapping in the transverse direction.

14. The electrical connector as claimed in claim 13, wherein in the extended state, in said two of the contacts the two second contacting portions are commonly located on a same lateral side of said two first contacting portions so as to form an outer first contacting portion, an inner first contacting portion, an inner second contacting portion and an outer second contacting portion sequentially arranged with one another along the transverse direction.

15. The electrical connector as claimed in claim 14, wherein in the finalized connector, the outer second contacting portion is aligned with the outer first contacting portion in the vertical direction, and the inner second contacting portion is aligned with the inner first contacting portion in the vertical direction.

* * * * *